US009401587B2

(12) United States Patent
Steiner

(10) Patent No.: US 9,401,587 B2
(45) Date of Patent: Jul. 26, 2016

(54) METHOD OF MANUFACTURING AN IGNITION PLUG

(71) Applicant: Federal-Mogul Ignition GmbH, Neuhaus-Schierschnitz (DE)

(72) Inventor: Thomas Steiner, Föritz (DE)

(73) Assignee: FEDERAL-MOGUL IGNITION GmbH, Neuhaus-Schierschnitz (DE)

( * ) Notice: Subject to any disclaimer, the term of this patent is extended or adjusted under 35 U.S.C. 154(b) by 0 days.

(21) Appl. No.: 14/932,762

(22) Filed: Nov. 4, 2015

(65) Prior Publication Data

US 2016/0141842 A1 May 19, 2016

(30) Foreign Application Priority Data

Nov. 14, 2014 (DE) ..... 10 2014 116 716
Mar. 12, 2015 (DE) ..... 10 2015 103 666

(51) Int. Cl.
*H01T 13/20* (2006.01)
*H01T 21/02* (2006.01)

(52) U.S. Cl.
CPC ..... *H01T 21/02* (2013.01)

(58) Field of Classification Search
CPC ..... H01T 2/00; H01T 4/06; H01T 4/10; H01T 13/467; H01T 13/20; F02P 3/02; F02P 5/00; F02P 9/007
See application file for complete search history.

(56) References Cited

U.S. PATENT DOCUMENTS 4,952,837 A * 8/1990 Matsumura ..... H01T 13/04 313/135
7,628,130 B2 * 12/2009 Johng ..... H01T 13/20 123/169 EL
8,167,673 B2 5/2012 Hartmann
2002/0055318 A1 5/2002 Ishiguro
2009/0227169 A1 * 9/2009 Nakamura ..... H01T 13/50 445/7
2010/0244651 A1 9/2010 Freeman

FOREIGN PATENT DOCUMENTS

DE 2614274 A1 10/1977
DE 102007042790 A1 3/2009
EP 0134355 A1 3/1985

OTHER PUBLICATIONS

German Office Action dated Aug. 12, 2015, 6 pages.

* cited by examiner

*Primary Examiner* — Tracie Y Green
(74) *Attorney, Agent, or Firm* — Reising Ethington, P.C.

(57) ABSTRACT

A method for producing a spark plug for internal combustion engines, having a metallic shell, a ceramic insulator held in the shell, a center electrode embedded in the insulator, and a ground electrode implemented as a bridge attached to the front end of the shell, wherein an end piece made of a precious metal is attached to the front end of the center electrode and a counterpart is attached to the bridge opposite the end piece, between which is formed a spark gap. A cylindrical body made fully or partially of the precious metal or precious metal alloy intended for the end piece and that is longer than the end piece is welded onto the front end of the center electrode. A bridge is used that has, in the center, a hole, the cross-section of which is matched to the cross-section of the cylindrical body. The bridge is placed on the front end of the shell in such a manner that the forward-facing end of the cylindrical body enters the hole in the bridge. The cylindrical body is welded to the bridge, and lastly the spark gap is created by cross-cutting the cylindrical body.

16 Claims, 2 Drawing Sheets

Fig.1
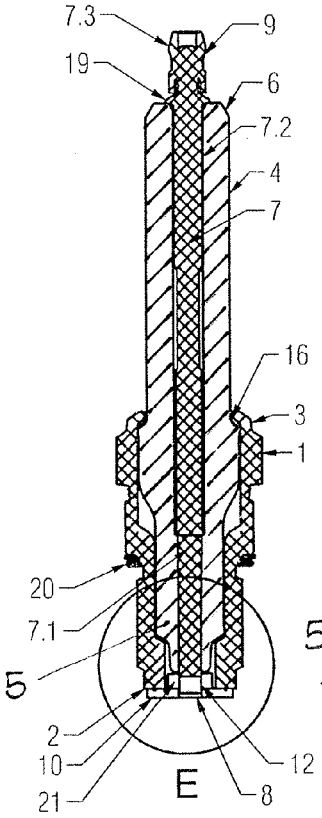
Fig.2
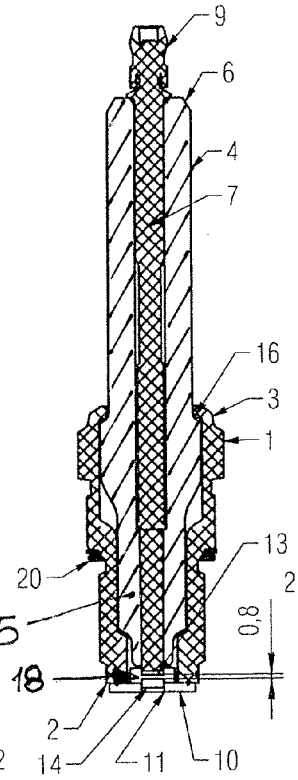
Fig.3
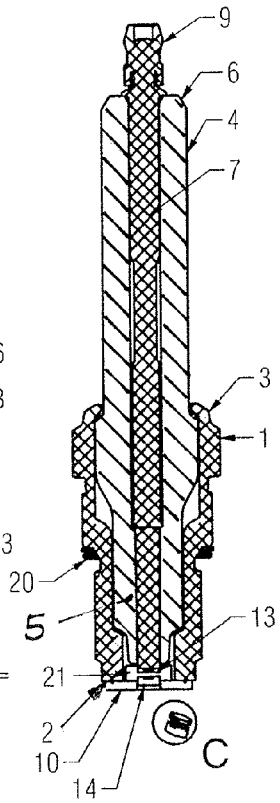
Fig.4
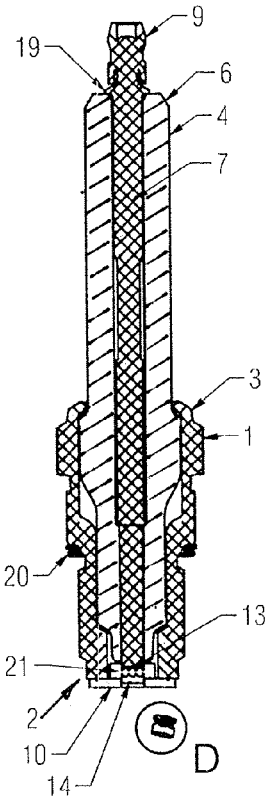
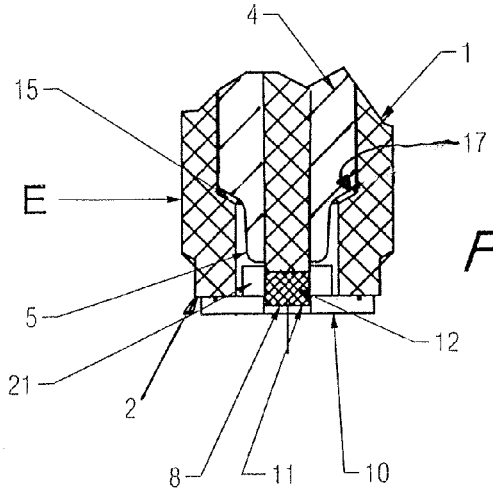
Fig.5

METHOD OF MANUFACTURING AN IGNITION PLUG

This Application claims the benefit of German Application No. 10 2015 103666.5, filed on Mar. 12, 2015 and German Application No. 10 2014 116716.3, filed on Nov. 14, 2014, the contents of which are hereby incorporated by reference in their entirety.

FIELD

The present invention is generally related to spark plugs and, more particularly, to spark plugs designed for gas-powered internal combustion engines.

BACKGROUND

A prior art spark plug referred to as a "bridge electrode type" spark plug is known and has the form of a bridge that extends diagonally over the front end of the shell of the spark plug. The center electrode is tipped with an end piece made of a precious metal. Opposite the center electrode, a counterpart made of precious metal is welded onto the bridge that serves as the ground electrode. The end piece and the counterpart delimit the spark gap.

The prior art spark plug is especially suitable for stationary gas engines and is characterized by a stable electrode arrangement that is suitable for a long service life.

A "bridge electrode type" spark plug, but without the precious metal tip on the center electrode and on the bridge, is known from EP Patent No. 0 134 355 A1.

The advantages of this spark plug type for use in gas engines, especially in stationary gas engines, are only fully evident if the arrangement of the center electrode and the electrode bridge can be produced with dimensional accuracy relative to one another. The cause of dimensional variations may reside in the fusing of the center electrode into the insulator, in the shrink-fitting of the insulator in the spark plug shell, in the process of crimping the back end of the spark plug shell, in the welding of the bridge onto the front edge of the spark plug shell, and in the welding of the precious metal pieces onto the bridge and onto the center electrode, and bring about dimensional variations in the spark gap, deviations from parallelism of the surfaces bordering the spark gap, and deviations in the alignment of the center electrode and the precious metal counterpart on the ground electrode coaxial to the spark plug center line. Keeping these error sources as small as possible requires great manufacturing effort and is in part responsible for a high price of the spark plugs for gas engines.

SUMMARY

An object of the present disclosure is to provide a way that spark plugs of this type can be produced with less effort without sacrificing dimensional accuracy.

This object may be attained by the method with the features specified in claim 1. Advantageous further developments of the method are the subject matter of the dependent claims.

The present method for producing a spark plug for internal combustion engines, in particular for gas-powered internal combustion engines, having:

a metallic shell that has an open front end and an open back end;

a ceramic insulator, held in the shell, that has a front end and a back end that projects from the back end of the shell;

a center electrode, embedded in the insulator, that has a back end that projects from the back end of the insulator and has a front end that projects from the front end of the insulator; and a ground electrode implemented as a bridge that is attached to the front end of the shell;

wherein an end piece made of a precious metal or a precious metal alloy is attached to the front end of the center electrode, and a counterpart is attached to the bridge opposite the end piece, between which is formed a spark gap that is set to a nominal width;

is characterized by the following production steps:

(a) a cylindrical body that is made fully or partially of the precious metal or precious metal alloy intended for the end piece and that is longer than the end piece is welded onto the front end of the center electrode;

(b) a bridge is used that has in the center, aligned with the center electrode, a hole, the cross-section of which is matched to the cross-section of the cylindrical body;

(c) the bridge is placed on the front end of the shell in such a manner that the forward-facing end of the cylindrical body enters the hole in the bridge;

(d) the cylindrical body is welded to the bridge; and (e) lastly, the spark gap is created by cross-cutting the cylindrical body.

A cylindrical body is understood here to mean a solid body in which two parallel, congruent bases, which do not have to be circular but can be circular, are connected to one another by a cylindrical surface.

It is preferable that the creation of the spark gap by cross-cutting of the cylindrical body is the last step of the method and at the same time is the sole manufacturing step that is important for the accuracy of the width and position of the spark gap and for the accuracy of the placement of the end piece that determines the spark gap. All other manufacturing steps, which in the prior art can affect the location, shape, and width of the spark gap, have already been completed when the spark gap is created by cross-cutting of the cylindrical body, so they are no longer able to adversely affect the accuracy of the spark gap. This has the further consequence that manufacturing steps performed prior to the cross-cutting of the cylindrical body need not be performed with the same high accuracy as in the prior art in order to achieve a precise spark gap geometry, because the precision thereof is determined only by the last manufacturing step of the method, namely by the cross-cutting of the cylindrical body. The process of cross-cutting the cylindrical body can be performed with high precision without special effort, however. In consequence, the use of the method may result in improved accuracy while at the same time reducing manufacturing effort.

In order to manufacture a spark plug according to the present method, it is possible to initially proceed as in the prior art: the shell of the spark plug, the insulator, and the center electrode can be prefabricated separately. Whereas in the prior art a precious metal disk, which forms the end piece, is welded onto the front end of the center electrode; according to the present method, the cylindrical body, the cross-cutting of which later creates the "end piece" and its counterpart, is welded onto the front end of the center electrode. The center electrode equipped with the cylindrical body is inserted into the insulator and is fused at its igniter into the insulator.

The insulator equipped with the center electrode can then be inserted into the shell of the spark plug from the back end, pushed forward to a stop, and secured by crimping the back end of the shell. In one embodiment, a bridge that has a hole in the center whose cross-section is matched to the cross-section of the cylindrical body can then be threaded onto the cylindrical body and welded to the front end of the shell. Threading of the bridge onto the cylindrical body readily results in centering of the bridge on the longitudinal center line of the center electrode. After this, the cylindrical body can be welded to the bridge without stresses occurring in the overall assembly. Finally, the spark gap is created by cross-cutting the cylindrical body. In another embodiment of the method, the cylindrical body can first be welded to the bridge, and the bridge can then be welded to the front end of the shell, before the spark gap is ultimately created by cross-cutting the cylindrical body.

In another embodiment, the cylindrical body can first be welded onto the front end of the center electrode, and then the center electrode inserted into the insulator, and the insulator inserted into the shell. After that, the hole in the bridge can be threaded onto the front end of the cylindrical body, by which means the bridge is centered on the longitudinal center line of the center electrode. Afterwards, the bridge can be welded to the shell and to the cylindrical body, with it being possible for the order of these two welding steps to be swapped. Lastly, the spark gap is created by cross-cutting the cylindrical body.

It is also possible, however, to first insert the center electrode in the insulator and then to weld the cylindrical body to the front end of the center electrode. After that, the insulator with fused center electrode and igniter can be inserted into the shell and fixed in place therein. If the bridge has already been welded to the front end of the shell beforehand, the cylindrical body is threaded into the hole in the bridge when the insulator is inserted into the shell. In this way, the starting parts are pre-centered on the longitudinal center line during joining (crimping) of the insulator body and shell. The cylindrical body is subsequently welded to the bridge. Alternatively, however, after the insulator has been inserted into the shell, the hole in the bridge can also be threaded onto the cylindrical body, and in this way be centered on the longitudinal center line of the center electrode. Then the bridge can be welded to the front end of the shell and to the cylindrical body, with it being possible for the order of these two welding steps to be swapped. Lastly, the spark gap is created by cross-cutting the cylindrical body.

In another embodiment, it is possible to proceed such that the cylindrical body is welded onto the front end of the center electrode after the center electrode has been inserted into the insulator and the insulator has been inserted into the shell. After that, the bridge can be threaded onto the front end of the cylindrical body and welded to the cylindrical body and to the front end of the shell, with it being possible for the order of these two welding steps to be swapped. Lastly, the spark gap is created by cross-cutting the cylindrical body.

On a first part of its length, the cylindrical body can be made of the precious metal or precious metal alloy intended for the end piece of the center electrode, and can be made on a second part of its length of a high-temperature metal such as, e.g. Inconel 600. In this context, the distribution of these two materials over the length of the cylindrical body can be chosen such that the spark gap is bounded on both sides by the precious metal or precious metal alloy after the cross-cutting of the cylindrical body. The section to be welded to the bridge can be made of the precious metal or precious metal alloy, or of the high-temperature steel. In the latter case, an economical use of precious metal and an optimal welding method are possible.

The spark gap can be perpendicular to the longitudinal axis of the cylindrical body. The precisely formed spark gap allows a reduction of the specific consumption of the surfaces that bound the spark gap, by which means the service life of the spark plug can be extended. Enlarged electrode areas can be created in that the cross-cutting of the cylindrical body takes place at an angle to the longitudinal axis of the cylindrical body other than 90°. In this case, it is useful for the opposing surfaces bounding the spark gap to be planar surfaces. It is also possible, however, for the surfaces bounding the spark gap to be placed such that they have, e.g., a zigzag shape. Especially large surface areas bounding the spark gap can be created in this way. Instead of a zigzag shape, the surfaces can also have a corrugated profile or a stepped profile, for example. The profiling of the two electrode surfaces can take place so as to result in a constant width of the spark gap. Even crisscross contours of the electrode surfaces can be created. Through the choice of a contour of the electrode, the electrode surfaces can be created. The ignition characteristics can be influenced in a directed manner through the choice of a contour of the electrode surfaces.

Wire erosion, laser beam cutting, and water jet cutting are examples of suitable methods for the final cross-cutting of the cylindrical body. These methods allow not only planar parting cuts, but also profiled parting cuts.

It is useful for the center electrode to have a cylindrical design at its front end.

The cylindrical body that is welded to the front end of the center electrode is also usefully cylindrical in design, and usefully has the same diameter as the front end of the center electrode. A cylindrical design of the center electrode and the cylindrical body is not mandatory, however.

The center hole in the bridge is usefully designed such that it has a slight oversize relative to the cylindrical body, the front end of which is intended to enter the hole. The oversize is usefully chosen such that the cylindrical body can easily enter the center hole in the bridge, but its lateral play therein is as small as possible.

The center hole in the bridge can be a blind hole. A through hole is preferred, however, which is usefully a bore when a cylindrical shape is used for the cylindrical body. Length tolerances of the insulator body, of the center electrode, or tolerances that arise during crimping, are compensated for in the bore. The cylindrical body is welded in the cylinder formed by the bore, or flush therewith. This can be accomplished with or without filler material.

DRAWINGS

Preferred exemplary embodiments of the invention will hereinafter be described in conjunction with the appended drawings, wherein like designations denote like elements, and wherein:

FIG. 1 is a simplified longitudinal section through an exemplary spark plug prior to the last step of the method;

FIG. 2 shows the spark plug from FIG. 1 after the last step of the method;

FIG. 3 shows a spark plug in a longitudinal section as in FIG. 2, but with a modified spark gap design;

FIG. 4 shows a spark plug in a longitudinal section as in FIG. 2, but with another modified spark gap design;

FIG. 5 shows the detail E from FIG. 1 in a larger scale;

DESCRIPTION

Figure 6:
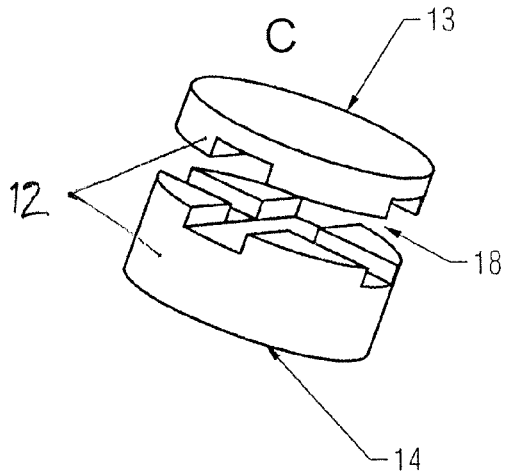
FIG. 6 shows the detail C from FIG. 3 in a larger scale.

Like or corresponding parts are labeled with matching reference numbers in the figures.

The semifinished spark plug shown in simplified form in FIG. 1 has a metallic shell 1 with a front end 2 and a back end 3. Inserted in the shell 1 is an insulator 4, which has a front end 5 and a back end 6, which projects out of the back end 3 of the shell 1. Inserted in the insulator 4 is a center electrode 7, which has a front section 7.1 and a back section 7.2, which is also referred to as an igniter, which together are fused in the insulator 4. The center electrode 7 has a front end 8 and a back end 9. The back end 9 projects beyond the back end 6 of the insulator 4, and is implemented as an electrical terminal 7.3. For the majority of its length, namely in the back section 7.2 and in the front section 7.1, the center electrode 7 is made of a base metal, for example of a nickel alloy. Welded onto the front end 8 of the center electrode 7, which projects out of the front end 5 of the insulator 4, is a cylindrical body 12, which is made of a precious metal or a precious metal alloy. The cylindrical body 12 preferably has the same diameter as the adjacent front section 7.1 of the center electrode 7, which is not made of a precious metal. Preferably, the cylindrical body 12 is a body in the form of a circular cylinder.

Figure 8:
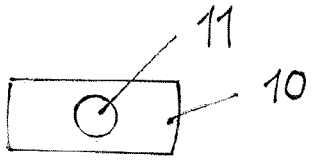
FIG. 8 shows, as a detail, a top view of the bridge shown in cross-section in FIG. 5.

Welded onto the front end 2 of the shell 1 is a bridge 10, which usefully is made of the same material as the shell 1. The bridge 10 is shown in a top view in FIG. 8. In the center, it has a bore 11, the diameter of which is matched to the diameter of the cylindrical body 12. A part of the length of the cylindrical body 12 projects into the bore 11. The semifinished spark plug shown in FIG. 1 can be produced as follows, for example:

The shell 1, the ceramic insulator 4, and the center electrode 7, which initially consists only of the back section 7.2 and the front section 7.1, are prefabricated individually. The cylindrical body 12, which is made of a precious metal or a precious metal alloy, for example platinum or iridium or a platinum alloy or an iridium alloy, in particular of a platinum-based alloy or an iridium-based alloy, is welded onto the front end 8 of the center electrode 7. The bridge 10 is also prefabricated. The bridge is usefully a plate-like structure with a length that does not exceed the diameter of the front end 2 of the shell 1, and with a width that is significantly smaller than its length. The prefabricated bridge 10 has the desired centrally located hole 11.

In order to assemble the spark plug, the front section 7.1 of the center electrode is pushed from behind into the insulator 4 to a stop. After that, conductive glass is poured in and the back section or igniter 7.2 is inserted. This is not shown in the drawings, but is generally known for spark plugs. In such a case, the two sections of the center electrode 7 can be joined to one another by melting of the glass, with this process helping to fix the center electrode 7 in place in the insulator 4. The part manufactured in this manner is referred to as a "complete insulator."

Together with the center electrode 7 inserted in it, the insulator 4 is pushed from behind into the shell 1 until its front external shoulder 15 strikes the internal shoulder 17 of the shell 1. These two shoulders 15 and 17 are conical in design, and in this way contribute to centering of the insulator 4 in the shell 1. In order to fix the insulator 4 in place in the shell 1, the back end 3 of the shell 1 is crimped inward against a back external shoulder 16 of the insulator 4.

For the sake of completeness, it is mentioned that an external thread, which is not shown, can be provided on the front section of the shell 1, with which thread the spark plug can be screwed into a matching threaded bore in the cylinder head of an internal combustion engine. A seal ring 20 can be provided adjacent to the threaded section.

Once the insulator 4 is fixed in place in the shell 1, the bridge 10 is arranged on the front end 2 of the shell 1 such that the cylindrical body 12 enters the bore 11 in the bridge 10, by which means the bridge 10 is centered on the longitudinal center line of the center electrode 7. Now the bridge 10 can be welded to the shell 1, and after that the cylindrical body 12 can be welded to the bridge 10, for example by electron-beam welding or by laser beam welding. FIG. 1 depicts the state of the semifinished spark plug reached in this way. It is still lacking the spark gap.

The missing spark gap 18 is shown in FIG. 2 and has a width of, for example, 0.8 mm. It is created by the means that the cylindrical body 12 is cross-cut at a location between the bridge 10 and the insulator 4, in particular by a wire erosion method. The requisite access to the location where the spark gap 18 is to be produced is possible because windows 21 are provided between the bridge 10 and the front end 2 of the shell 1, through which windows the fuel/air mixture to be ignited can also reach the spark gap 18. A spark gap 18 with uniform width can be produced in a precise manner by wire erosion, by laser beam cutting, or by water jet cutting.

FIG. 2 shows a spark gap 18 that is bounded by two planar, mutually parallel surfaces that extend at a right angle to the longitudinal center line of the center electrode 7.

Figure 7:
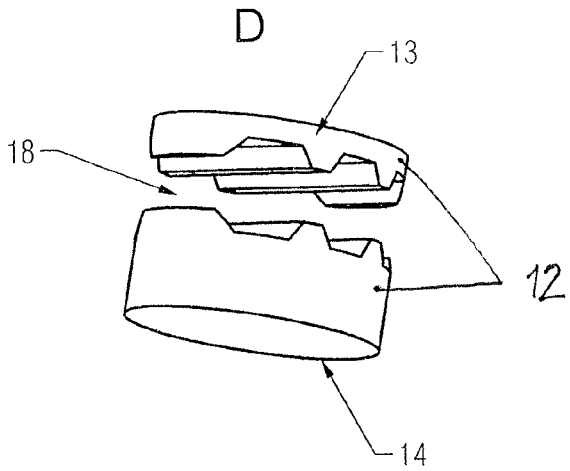
FIG. 7 shows the detail D from FIG. 4 in a larger scale.

FIGS. 3 and 6 show how one can divide the cylindrical body 12 by wire erosion, for example, and create a spark gap 18 that is not bounded by two planar surfaces, but rather by profiled surfaces. Another example in which the spark gap 18 is bounded by profiled surfaces that are produced by dividing the cylindrical body 12, for example by wire erosion, is shown in FIGS. 4 and 7. In FIGS. 3 and 6, the surfaces bounding the spark gap 18 have a crossed shape. In FIGS. 4 and 7, the surfaces bounding the spark gap have a zigzag shape. The ignition characteristics of the spark plug can be influenced in a directed manner and optimized by profiling the surfaces bounding the spark gap 18. The spark plugs shown in the figures differ only in their spark gap geometry.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMBERS

1 shell
2 front end of shell
3 back end of shell
4 insulator
5 front end of insulator

6 back end of insulator
7 center electrode (complete)
7.1 front section of the center electrode
7.2 back section of the center electrode
7.3 cable nut or electrical terminal
8 front end of center electrode
9 back end of center electrode
10 bridge
11 bore or hole in bridge
12 cylindrical body
13 end piece
14 counterpart
15 front external shoulder of insulator
16 back external shoulder of insulator
17 internal shoulder of shell
18 spark gap
19 collar
20 seal ring
21 window

The invention claimed is:

1. A method for producing a spark plug for internal combustion engines, the spark plug having:

a metallic shell that has an open front end and an open back end;

a ceramic insulator, held in the shell, that has a front end and a back end that projects from the back end of the shell;

a center electrode, embedded in the insulator, that has a back end that projects from the back end of the insulator and that has a front end that projects from the front end of the insulator; and a ground electrode in the form of a bridge that is attached to the front end of the shell;

wherein an end piece made of a precious metal or a precious metal alloy is attached to the front end of the center electrode, and a counterpart is attached to the bridge opposite the end piece, between which is formed a spark gap that is set to a nominal width;

the method comprises the steps of:

(a) welding a cylindrical body that is made fully or partially of the precious metal or precious metal alloy intended for the end piece and that is longer than the end piece onto the front end of the center electrode;

(b) providing a bridge that has in the center, aligned with the center electrode, a hole, the cross-section of which is matched to the cross-section of the cylindrical body;

(c) placing the bridge on the front end of the shell in such a manner that the forward-facing end of the cylindrical body enters the hole in the bridge;

(d) welding the cylindrical body to the bridge; and (e) creating, the spark gap by cross-cutting the cylindrical body.

2. The method of claim 1, wherein:

first welding the cylindrical body onto the front end of the center electrode;

then inserting the center electrode into the insulator, and inserting the insulator into the shell;

after that, welding the bridge, centered by the cylindrical body, to the shell and to the cylindrical body; and lastly, creating the spark gap by cross-cutting the cylindrical body.

3. The method of claim 1, wherein:

first inserting the center electrode into the insulator, and then welding the cylindrical body onto the front end of the center electrode;

after that, inserting the insulator into the shell; and lastly, creating the spark gap by cross-cutting the cylindrical body.

4. The method of claim 1, wherein:

after the center electrode has been inserted into the insulator and the insulator has been inserted into the shell, welding the cylindrical body onto the front end of the center electrode; and lastly, creating the spark gap by cross-cutting the cylindrical body.

5. The method of claim 1, wherein the bridge is welded to the shell and to the cylindrical body after the center electrode equipped with the cylindrical body has been inserted into the insulator and after the insulator has been inserted into the shell.

6. The method of claim 1, wherein the bridge is welded to the shell and after that the insulator equipped with the center electrode to which the cylindrical body is welded is inserted into the shell and in the process the forward-facing end of the cylindrical body enters the hole in the bridge and is centered, and after that the cylindrical body is welded to the bridge.

7. The method of claim 1, wherein on a first part of its length, the cylindrical body is made of the precious metal or precious metal alloy intended for the end piece, and on a second part of its length the cylindrical body made of a high-temperature metal, wherein the distribution of these two materials over the length of the cylindrical body is chosen such that, after the cross-cutting of the cylindrical body, the end piece attached to the front end of the center electrode is made of the precious metal or the precious metal alloy, and the section of the cylindrical body made of the high-temperature metal is wholly or partially inserted into the hole in the bridge.

8. The method of claim 7, wherein the spark gap is created such that it is bounded on both sides by the precious metal or by the precious metal alloy.

9. The method of claim 1, wherein the spark gap is placed such that it is bounded by two mutually opposing surfaces that are equal to or larger than the cross-section of the cylindrical body perpendicular to the longitudinal axis of the cylindrical body.

10. The method of claim 9, wherein the spark gap is created such that it is bounded by surfaces that enclose, with the longitudinal axis of the cylindrical body, an angle other than 90 degrees.

11. The method of claim 9, wherein the two surfaces bounding the spark gap are placed such that they have a zigzag, corrugated, and/or crossed shape.

12. The method of claim 1, wherein the spark gap is created by wire erosion, by laser beam cutting, or by water jet cutting.

13. The method of claim 1, wherein the welding of the cylindrical body to the bridge is carried out after the welding of the bridge to the shell.

14. The method of claim 1, wherein the center electrode is cylindrical in design at its front end, and the cylindrical body that is welded to the front end of the center electrode is likewise cylindrical in design.

15. The method of claim 1, wherein the center hole in the bridge is designed such that it has a slight oversize relative to the cylindrical body, the front end of which is intended to enter the hole.

16. The method of claim 1, wherein the hole in the bridge is created as a through hole.

* * * * *